US006866264B2

(12) United States Patent
Dobrindt

(10) Patent No.: US 6,866,264 B2
(45) Date of Patent: Mar. 15, 2005

(54) BLOCKING DEVICE FOR A DEVICE FOR MOVING A SHEET

(75) Inventor: Dirk Dobrindt, Klausdorf / Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 127 days.

(21) Appl. No.: 10/315,722

(22) Filed: Dec. 10, 2002

(65) Prior Publication Data

US 2003/0156879 A1 Aug. 21, 2003

(30) Foreign Application Priority Data

Dec. 10, 2001 (DE) ..... 101 60 381

(51) Int. Cl.[7] ..... B65H 5/00

(52) U.S. Cl. ..... 271/264; 271/272; 271/226; 271/314; 271/207

(58) Field of Search ..... 271/264, 272, 271/314, 207, 254, 256, 10.05, 16.13

(56) References Cited

U.S. PATENT DOCUMENTS 4,480,825 A * 11/1984 Landa ..... 271/81
5,335,904 A * 8/1994 Ryuzaki ..... 271/272
5,513,839 A * 5/1996 Green ..... 270/58.07
5,884,135 A * 3/1999 Moore ..... 399/361

* cited by examiner

*Primary Examiner*—Donald P. Walsh
*Assistant Examiner*—Kaitlin Joerger
(74) *Attorney, Agent, or Firm*—Lawrence P. Kessler

(57) ABSTRACT

A device for moving a sheets transversely to its conveying direction with a toothed belt for driving a spindle, whose conveyor rollers for grasping the sheet are attached with a blocking device with at least two toothed gears on the drive belt, whereby the toothed gears have blocking members that strike each other based on a certain gear transformation ratio of the two toothed gears following a certain number of rotations of the toothed gears and which block the movement of the toothed gears.

3 Claims, 3 Drawing Sheets

BLOCKING DEVICE FOR A DEVICE FOR MOVING A SHEET

FIELD OF THE INVENTION

The invention relates to a device for moving a sheet transversely to its conveying device, as well as a blocking device.

BACKGROUND OF THE INVENTION

With printing presses, the exact alignment of the conveyed printing material on a conveyor belt is of considerable importance for the desired application of the printing format in the correct position on the printing material. Sheets of printing material may be conveyed on a conveyor belt through the printing press, whereby misalignments of the sheets transverse to the conveying direction are corrected by sheet-grasping conveyor rollers that solve the problem (see for example U.S. Pat. No. 5,322,273). Furthermore, sheets are moved as desired before being deposited on a stack following the printing process, in order to arrange the sheets so that they are offset on the stack. The printing press operator can subsequently remove the sheets in staggered piles without having to sort them.

The conveyor rollers are attached to a shaft, unroll on the printing material and are moved by a spindle in the shaft transverse to the conveying direction corresponding to a calculated transverse movement of the sheets. Due to the friction force of the conveyor rollers on the sheets, the sheets are transversely moved according to the transverse movement of the conveyor rollers. The spindle, which is moved in the conveying direction of the sheets, can be driven by a belt drive of a stepping motor. The stepping motor receives corresponding control signals from a control device of the printing press, which are adjusted to the dimensions of the calculated dimensions of the misalignment to be corrected or the desired offset of the sheets on the conveyor belt. The stepping motor is connected to a belt drive, which converts the rotating movement of the stepping motor into movement of the spindle. It must be ensured that that the spindle in the shaft, to which the conveyor rollers are attached, does not exceed a certain range of travel. If the range of travel is continuously exceeded by the spindle and therefore by the shaft, this may lead to damages of the spindle, the shaft, as well as to the shaft housing, and to the failure of the device for offsetting the sheets.

A solution to the described problem is found in adjusting the drive of the stepping motor to the maximum permissible range of travel of the spindle, i.e., when the stepping motor has carried out a certain number of steps in one direction, the stepping motor is stopped. However, this solution is only permanently suitable if the driving of the stepping motor can be carried out with high reliability. The stepping motor is driven by software in the control device of the printing press. If the software fails, which happens frequently, the accurate driving and the reduction of the spindle movement at a maximum permissible range of travel is not guaranteed. A further solution to the existing problem mentioned is the use of light barriers, which monitor the end positions of the range of travel and signal the control device. Failure of the light barriers, however, equally leads to the failure of the protection before the permissible range of travel is exceeded, and thus does not represent any suitable solution.

SUMMARY OF THE INVENTION

One task of the invention is to provide the movement of a sheet transverse to its conveying direction that is cost-effective, reliable and secure. Another task of the inventions is to provide a blocking device for blocking the movement of the toothed gears.

The invention solves the tasks with a device for movement of a sheet transverse to its conveying direction with a belt drive for driving the spindle, to which conveyor rollers for grasping the sheet are attached, and which has a blocking device with at least two toothed gears per belt drive, whereby the toothed gears are used as blocking members. Based on a certain gear transformation ratio of the two toothed gears, according to a certain number of rotations of the toothed gears, the gears strike each other and block the movement of the gears. Furthermore, a device with at least two toothed gears with blocking members is provided, which, following a certain number of rotations of the toothed gears based on a certain number of rotations of the toothed gears based on a certain gear transformation ratio of the toothed gears strike against each other and block the movement of the toothed gears.

The first blocking member advantageously contains a limit stop and the second locking member contains a tappet. The blocking of the movement of the toothed gears is carried out with these configurations in reliable and cost-effective ways. With one embodiment of the invention, the number of rotations of the toothed gears up until the blocking of the toothed gears can be influenced by the shape of the blocking member. The larger the shape of the blocking members, the sooner the blocking members strike each other and subsequently, the lower the number of rotations of the toothed gears until they lock are blocked.

Below, the invention is described with respect to the figures in detail, wherein.

DETAILED DESCRIPTION OF THE INVENTION

Figure 1:
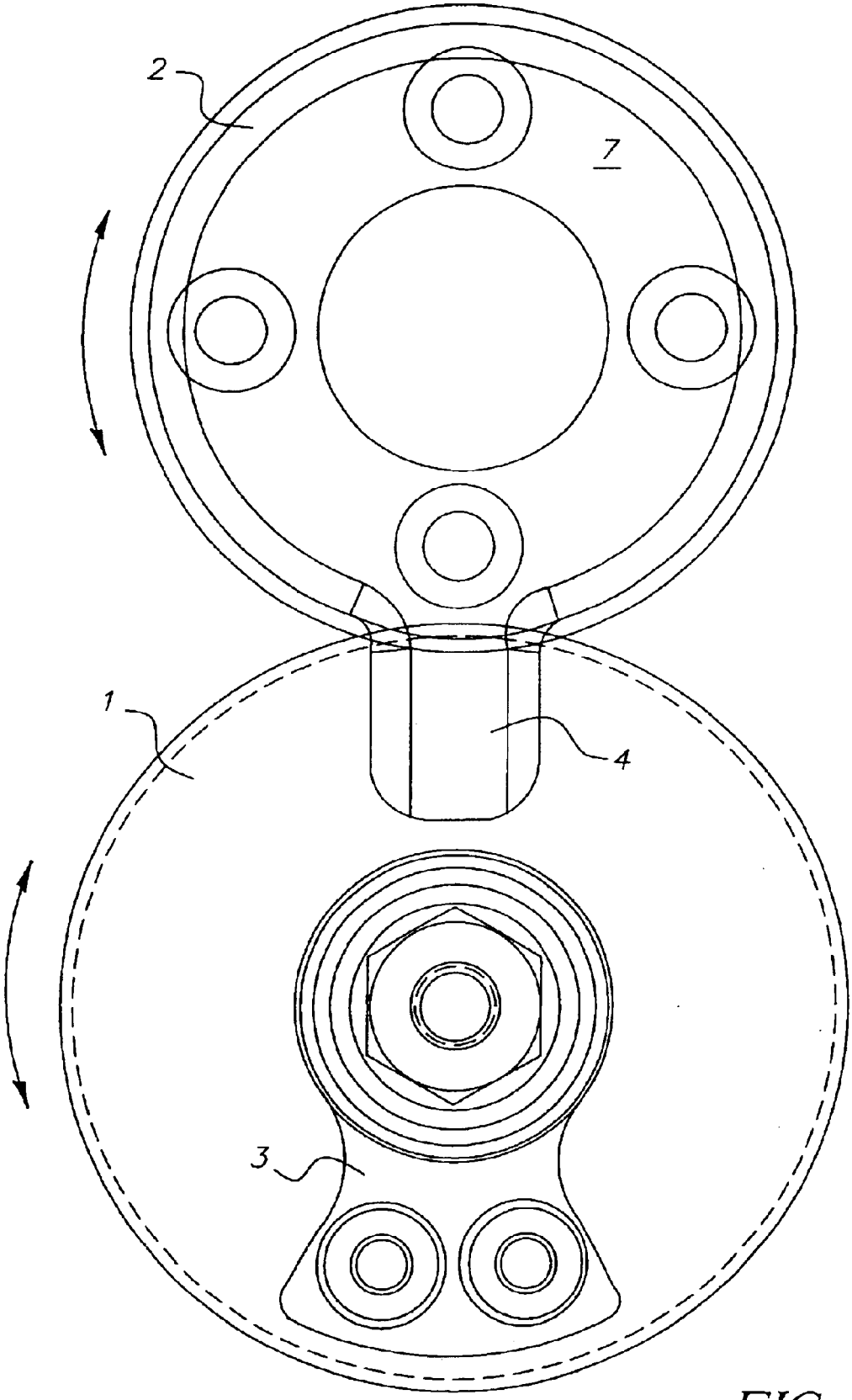
FIG. 1 shows a transparent representation of two toothed gears, each of which has a blocking member, according to this invention.

FIG. 1 shows a transparent representation of a first toothed gear 1 in addition to a second toothed gear 2, which are in operative connection via ring gears, which are symbolically represented. The toothed gears 1, 2 have a specific gear ratio, which is not equal to one. The first toothed gear 1 includes a limit stop (3) that is firmly attached to a lateral surface of the first toothed gear 1, with this limit stop screwed to this lateral surface of the first toothed gear 1 in this example. The second toothed gear 2 includes a ring 7, which is firmly attached to a lateral surface of the second toothed gear 2, and a limit stop, such as tappet 4, which is one piece with the ring 7. The limit stop 3 and the tappet 4 are located on one level and are shaped in such a way that these strike against each other when they are aligned. When the limit stop 3 strikes tappet 4, the movement of the toothed gears 1, 2 is stopped, which subsequently acts as a blocking device, according to the representation in FIG. 1.

In FIG. 1, the limit stop 3 and tappet 4 are aligned in one direction at the same angle, which is the initial position of the blocking device. By driving the toothed gears 1, 2 in a rotating position, the alignment angles of the limit stop 3 and the tappet 4 change, since they are firmly attached to the first toothed gear 1 and the second toothed gear 2. The alignment angle of limit stop 3 following the movement of toothed gears 1,2 from the initial position is not equal to the alignment angle of tappet 4, since the gear transformation ratio of toothed gears 1,2 is not equal to 1. According to a certain number of rotations of toothed gears 1, 2, whereby the number of rotations of the first toothed gear 1 is not equal to the number of rotations of the second toothed gear 2, the limit stop grasps the counter-rotating tappet 4 in regard to limit stop 3, and the driving of the toothed gears 1, 2 is stopped. The gear transformation ratio may take any rational number.

Figure 2:
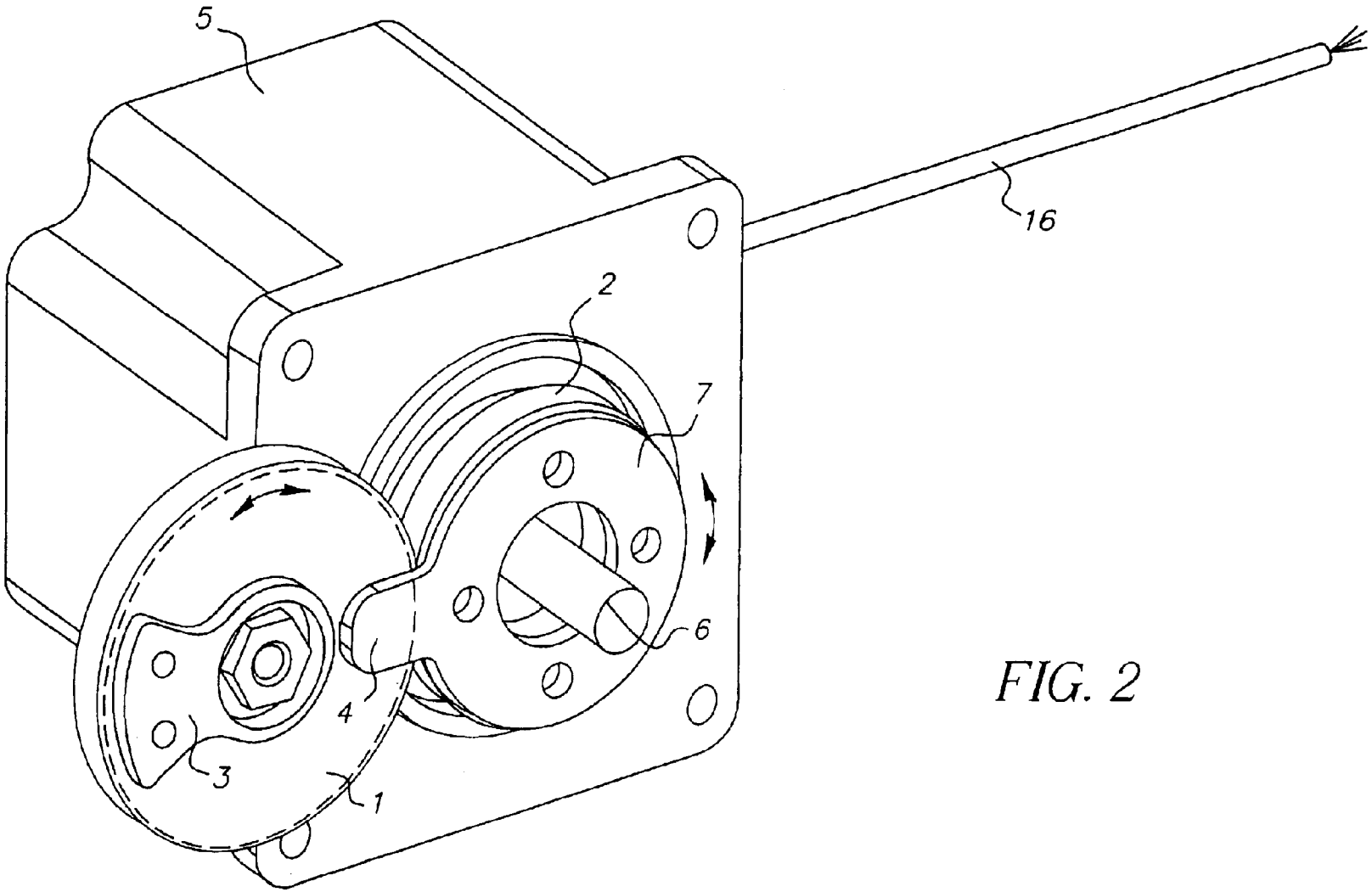
FIG. 2 shows a perspective representation of the two toothed gears, each with a blocking member according to FIG. 1, attached to a stepping motor.

FIG. 2 shows a perspective representation of the two toothed gears 1, 2, which each have a blocking member, the limit stop 3 and the tappet 4, according to FIG. 1. The blocking device is connected to a stepping motor 5, which drives the second toothed gear 2 by a shaft 6, and is controlled by a connecting line 16 from a control device of a printing press. The stepping motor 5 can be driven in both directions, so that shaft 6 and toothed gear 1 have two rotating directions. The ring gear of the second toothed gear 2 engages the ring gear of the first toothed gear 1. The first toothed gear 1 is thus moved in the opposite direction of the second toothed gear 2. Following a certain number of rotations of shaft 6 in one direction, which can be set by the gear transformation ratio of the first toothed gear 1 to the second toothed gear 2, tappet 4 strikes limit stop 3 and the stepping motor 5 is blocked due to the blocking formed between the opposing forces of tappet 4 and limit stop 3, although the control device is driving stepping motor 5 and the circuit of stepping motor 5 remains open. Toothed gears 1, 2 carry out a certain number of rotations in one direction, whereby the number may be any rational number, before the blocking occurs. It is understandable that the number of rotations of toothed gears 1, 2 up until blocking is based on the initial position represented, whereby limit stop 3 and tappet 4 have the same alignment angle, which is the same in both rotating directions.

Figure 3:
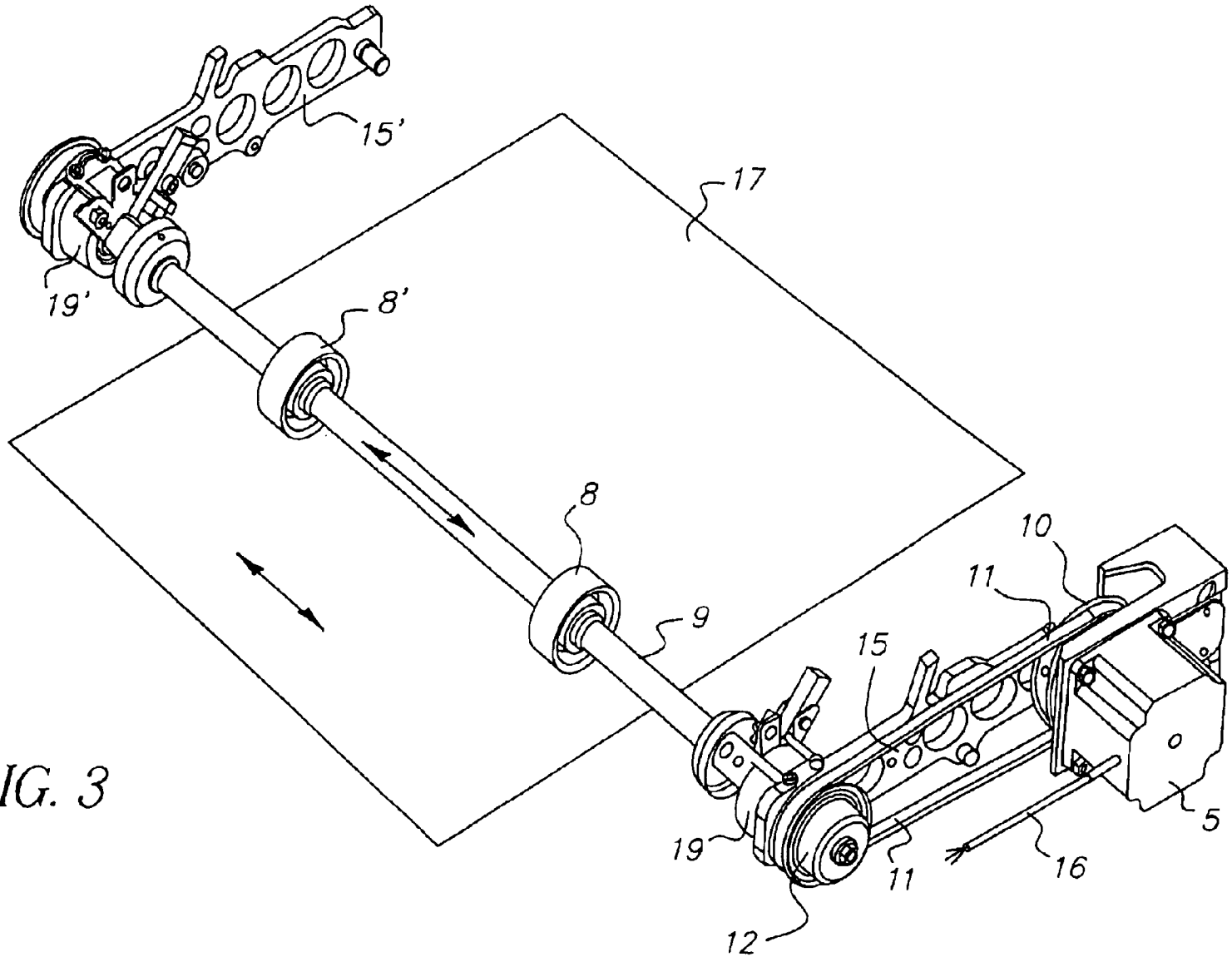
FIG. 3 shows a perspective representation of a device for moving a sheet transversely to its conveying direction.

To clarify the use of the blocking device, FIG. 3 shows the blocking device according to FIG. 2 in a perspective view of the device for moving a sheet transversely to its conveying direction, whereby the device is a section of a conveying path of a printing press. The device includes in this connection two frames 15, 15' that are arranged in opposite directions and approximately parallel to each other and which are secured to a printing press. The frames 15, 15' are connected to each other by a rod 9, which extends through openings in the frames 15, 15'. The rod 9 is positioned so that it can be rotated in frames 15, 15' and, in this example, includes two conveyors rollers 8, 8' that are firmly connected with rod 9, and which exert a contact force on sheets 17 conveyed on a conveyor belt. The spindle, which moves rod 9 in both directions of the arrows, is located in rod 9.

The drive of the spindle and of rod 9 is provided by the stepping motor 5, which is driven by the control device of the printing press via connection line 16. The stepping motor 5 is configured in the manner represented in FIG. 2 with shaft 6 and toothed gears 1, 2, limit stop 3 and tappet 4. Furthermore, on shaft 6 at one end of frame 15, a first pulley 10 is attached and firmly connected with the frame 15. At the other end of the frame 15, a second pulley 12 is located. A drive belt 11 is stretched around the first pulley 10 and the second pulley 12. By the shaft 6, the drive of stepping motor 5 subsequently moves the first pulley 10, which transfers the movement to the second pulley 12 by drive belt 11.

The second pulley 12 is connected with the spindle in rod 9, which extends through frame 15. The rod 9 secured to the spindle can thus be moved in the direction represented by the double arrow, depending upon the spindle pitch selected. The drive of stepping motor 5 and shaft 6 thus causes a movement of rod 9, which is in operative connection with the spindle. With the help of the above-described blocking device, the movement of rod 9 along the spindle is independent of the driving of stepping motor 5, i.e., independent of whether stepping motor 5 supplies power that can be reliably limited. When during the movement of rod 9, an end position of rod 9 is reached in the longitudinal direction, which is not to be exceeded, the blocking device blocks the movement of rod 9. The blocking at the end position is determined by the knowledge of the pitch of the spindle, by the path of the middle position of the spindle to the end position in both directions, by the gear transformation ratio between toothed gears 1, 2, of the gear transformation ratio of the belt drives 10, 11, 12, by the increment of the steps of stepping motor 5, and finally by knowledge of the shape of limit stop 3 and tappet 4.

With knowledge of the requirements for the spindle pitch, the path of the middle position of the spindle to the end position, of the gear transformation ratio of the belt drives 10, 11, 12 and of the increment of the steps of stepping motor 5, the gear transmission ratio 1,2 is adjusted, as well as the shape of limit stop 3 and tappet 4, if applicable. The wider these are approximately configured, the smaller the gear transformation ratio of the toothed gears 1, 2, during otherwise identical conditions. The blocking of the rotating movement of the toothed gears 1, 2 prevents wear and tear or damage to the spindle or bearings 19, 19' in the end position. The impact of the spindle in bearings 19, 19' at the end position leads to material fatigue or breakage, such that the spindle should be prevented from reaching the end position of the spindle in its movement in rod 9.

Limiting the movement of the spindle by the corresponding drive of stepping motor 5 does not offer any reliable solution. Herein, the number of steps of the stepping motor 5 is counted in one direction and limited in relationship to the movement of the spindle. When stepping motor 5 reaches a maximum number of steps in one direction, it is stopped, and in this manner, it is prevented from reaching the end position of rod 9 and the spindle. Likewise, the use of a light barrier with rod 9, which is moved with the spindle, does not offer any reliable solution. According to FIG. 1 with the proposed embodiment, after stepping motor 5 is blocked by limit stop 3 and tappet 4 at the end position, stepping motor 5 is moved in the other direction of rotation, limit stop 3 and tappet 4 move apart from each other and are moved into the initial position of the blocking device, which is defined by a middle position between bearings 19, 19'. Rod 9 is lifted at this point, so that the conveyor rollers 8, 8' on the sheets 17 conveyed on the conveyor belt are not influenced by the running of the blocking device into the initial position. The solution suggested in the embodiment is completely carried out mechanically and is free from defects in the control electronics, control software or by electronic devices and guarantees a secure, reliable and continuous protection for limiting the movement of a spindle connected with the blocking device and rod 9.

I claim:

1. In a device for moving a sheet (17) transversely to its conveying direction, including a drive (10, 11, 12) for driving a spindle, and conveyor rollers (8,8') attached to said spindle to grab a sheet (17) and move such sheet transversely under the influence of said drive, a blocking device comprising: at least two toothed gears (1, 2) mounted in mutually engaging relation for rotation about respective spaced axes, said at least two toothed gears associated with said drive (10,

11, 12) for effecting transverse movement of said spindle, and thus such sheet, said toothed gears (1, 2) respectively having blocking members (3, 4), which, based on a certain gear transformation ratio of the two toothed gears (1, 2), following a certain number of rotations of the toothed gears (1, 2), strike each other and block the movement of the toothed gears (1, 2) to prevent further transverse movement of said spindle.

2. The blocking device according to claim 1, wherein one of said blocking members is a limit stop (3) on the first toothed gear (1), and another of said second blocking members is a tappet (4) on the second toothed gear (2).

3. The blocking device according to claim 1, wherein the number of rotations of the toothed gears (1, 2) up until the blocking of toothed gears (1, 2) is influenced by the shape of said limit stop (3) and said tappet (4) of said blocking members.

* * * * *